US005297682A

United States Patent [19]

Miltenberger

[11] Patent Number: 5,297,682

[45] Date of Patent: Mar. 29, 1994

[54] VOLUMETRIC CORNER PROTECTOR

[76] Inventor: Charles W. Miltenberger, 29208 San Francisquito Cyn, Saugus, Calif. 91350

[21] Appl. No.: 31,541

[22] Filed: Mar. 17, 1993

[51] Int. Cl.[5] ..... B65D 69/00; B65D 71/00

[52] U.S. Cl. ..... 206/586; 206/453

[58] Field of Search ..... 206/453, 586; 229/DIG. 1

[56] References Cited

U.S. PATENT DOCUMENTS

| | | | |
|---|---|---|---|
| 2,476,197 | 7/1949 | Kincaid | 229/DIG. 1 |
| 2,509,468 | 5/1950 | Anderson, Jr. | 229/DIG. 1 |
| 3,220,683 | 11/1965 | Doll | 206/586 |
| 3,900,156 | 8/1975 | Clark, Jr. | 206/586 |
| 4,192,423 | 3/1980 | Rekow | 229/DIG. 1 |
| 4,529,091 | 7/1985 | Martin | 206/453 |

FOREIGN PATENT DOCUMENTS

| | | | |
|---|---|---|---|
| 1270667 | 7/1961 | France | 229/DIG. 1 |

*Primary Examiner*—Paul T. Sewell
*Assistant Examiner*—Marie Denise Patterson

[57] ABSTRACT

A cushioning corner pad is placed on the corners of furniture or the like to protect it during shipment. The corner pad is die-cut, prescored, and folded from a single piece of corrugated paper board to a three-dimensional form consisting of three connected triangular hollow cells which fit the corner of the article to be protected. The thickness of the cells, and thus the corner pad, is determined by sections which are perpendicular to, and sections diagonal to, the parallel sides of each of the connected cells when folded. The corner pad is thus hollow and fits over the corner of an artical with a cell adjacent to each side of the corner.

1 Claim, 4 Drawing Sheets

Fig 5a.
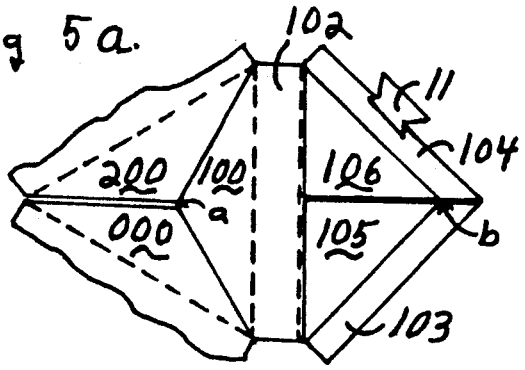
Fig 5b.
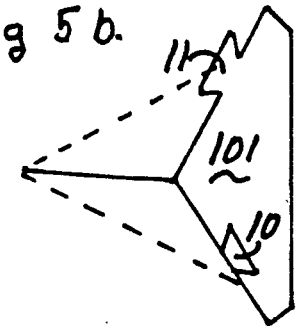
Fig 5a1.
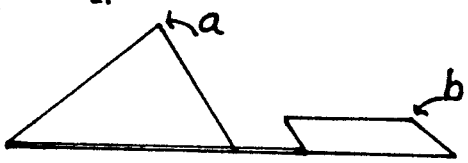
Fig 5b1.
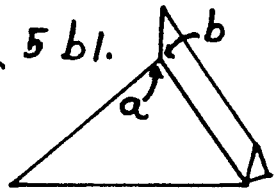
Fig 6a.
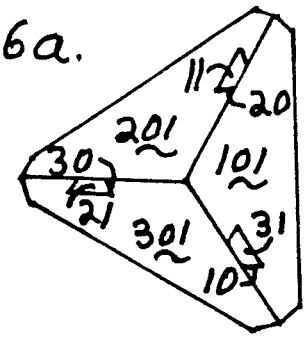
Fig 6c
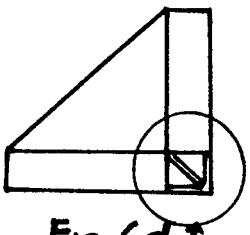
Fig 6d
Fig 6b.
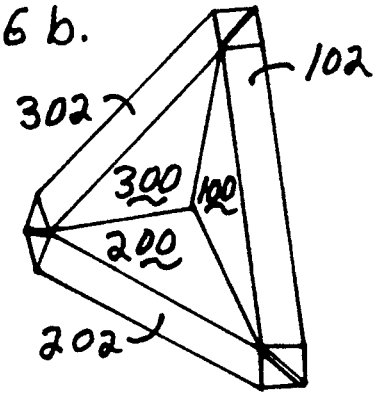
Fig 6 d.
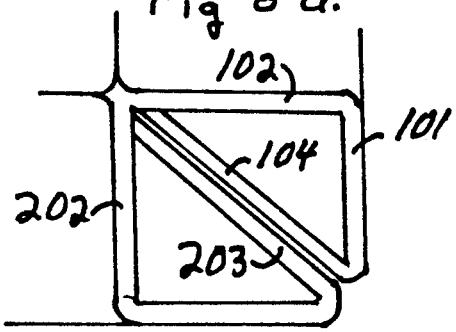

VOLUMETRIC CORNER PROTECTOR

IDENTIFICATION OF RELATED APPLICATION

A Volumetric Corner Protector, made of corrugated paperboard or the like, is disclosed in this application. This protector is designed to be used on the corners of items to be shipped, including but not limited to furniture, speaker cabinets, etc., to prevent any possible damage to the item during shipment. The protector is first made in a flat, knocked-down configuration, and then easily assembled, either by hand or machine, into its three-dimensional form so as to fit over the item at its corners. The protector is made to have a predetermined thickness as to protect the item during shipment and maintain a desired spacing between the item and the shipping carton in which the protector the item are contained.

BACKGROUND OF THE INVENTION

This invention is a corner protector for use in the shipping of an item, such as furniture or a speaker cabinet, which when applied to the corners of the item being shipped and placed in a shipping carton protects the corners of the item and holds the item intact during shipment.

Before this invention, corner protectors made of several layers of corrugated material construction, corner protectors of a single face laminated built-up construction, or a corner protector made of a pre-formed molded synthetic resin foam construction, had been applied to the corners of items such as furniture or speaker cabinets for shipping protection. In the case of the layered corrugated material, the item frequently broke or was damaged when dropped, due to its high rate of energy transfer. The latter two corners had a tendency to crush or break during shipment thus resulting in the item being loose inside the shipping container and leaving it vulnerable to further damage. When this happened, the stacking capability of the loosened items within their shipping container was diminished. There has been a need for a corner protector which could balance the importance of noncrushability and low energy transfer, be relatively inexpensive, and could be shipped in a spaced saving configuration (flat) for use, all of which are represented by this invention.

SUMMARY OF THE INVENTION

Among several features of this invention, the Volumetric Corner Protector, is that the protector is made from a single piece of blank corrugated paperboard, or the like, that can be shipped to the end user in a flat, knocked down form which may be repeatedly assembled into its three dimensional form with or without the aid of special equipment, such as an automatic folding machine.

The provision of such a corner protector which has the advantages discussed in the background of the invention, thereby to provide additional protection through design flexibility of size, material, and thickness, with only minor changes in the folding pattern. This will allow ease in manufacturing, the economical development of automatic folding equipment, and a corner protector which is easily scalable to provide improved overall protection.

Other features of this corner protector will be in part apparent and in part pointed out hereafter.

Briefly stated, a corner protector of the present invention is applicable to the corners of an item, such as a piece of furniture or a speaker cabinet or the like, so as to firmly support the corners of the item within an over-carton or shipping container with a predetermined but variable space between the item and the inner faces of the shipping carton. The corner protector is made from a single pre-cut and pre-scored rigid foldable material such as corrugated paperboard or the like. This single piece of material has for inner triangles and three larger outer triangles defined by a cut and fold lines, which when folded form the inner and outer panels of a three dimensional corner protector. The sections between these inner and outer panels are created by fold lines and the distance between these lines determined the final thickness of the corner protector. These sections, when folded, form support sections which are relatively perpendicular to both the inner and outer panels. There are six smaller triangles on the form which are separated from the large triangular outer panels by two fold lines. The distance between these fold lines is related to the perpendicular support distance. These sections, when folded, form diagonal supports for the inside edges of the inner panels. The six small triangles, when folded, hold the diagonal supports in position. Common locking tabs are used to hold the corner protector together by locking the outer panels, although other locking mechanisms may be used. The single form just described, when folded, becomes a single relatively symmetrical form, which has three relatively equal cushioning cells, to place over the corner of an item. Each cell protects one side of the corner, and together protect the object from the forces caused by dropping or the like.

A BRIEF DESCRIPTION OF THE DRAWINGS

FIG. 1 shows the blank form of one embodiment of the present invention in the form of a Volumetric Corner Protector.

FIGS. 2*a* and 2*b* show the formation of three perpendicular panels formed after the first folds.

FIGS. 3*a*, 3*b*, 3*c*, 3*a*1, 3*b*1, and 3*c*1 show the partial folding of one of the three typical sections.

FIG. 4 shows the folding of FIG. 2*a* after all of the typical sections (FIG. 3*a*–FIG. 3*c*1) have been partially folded.

FIGS. 5*a*, 5*b*, 5*a*1, and 5*b*1 show the final fold of a typical partially folded section (FIG. 3*c*) against the backs of the perpendicular panels in FIG. 2*b*.

FIGS. 6*a*, 6*b*, 6*c* and 6*d* show the perspective view of the Volumetric Corner Protector (FIG. 1) completely folded, and a view of the diagonal and perpendicular supports formed during folding.

DETAILED DESCRIPTION

The Volumetric Corner Protector of this invention is formed from a single sheet of corrugated paperboard or the like, that is scored, cut, and folded in a specific manner. This corner protector is so constructed as to have space between the inner and outer surfaces. This space is provided by the perpendicular and diagonal supports which are the results of the unique folding design further described herein. The corner protector of this construction provides positioning of an article within a shipping container, and offers protection of the article from damage caused by dropping or the like.

Figure 1:
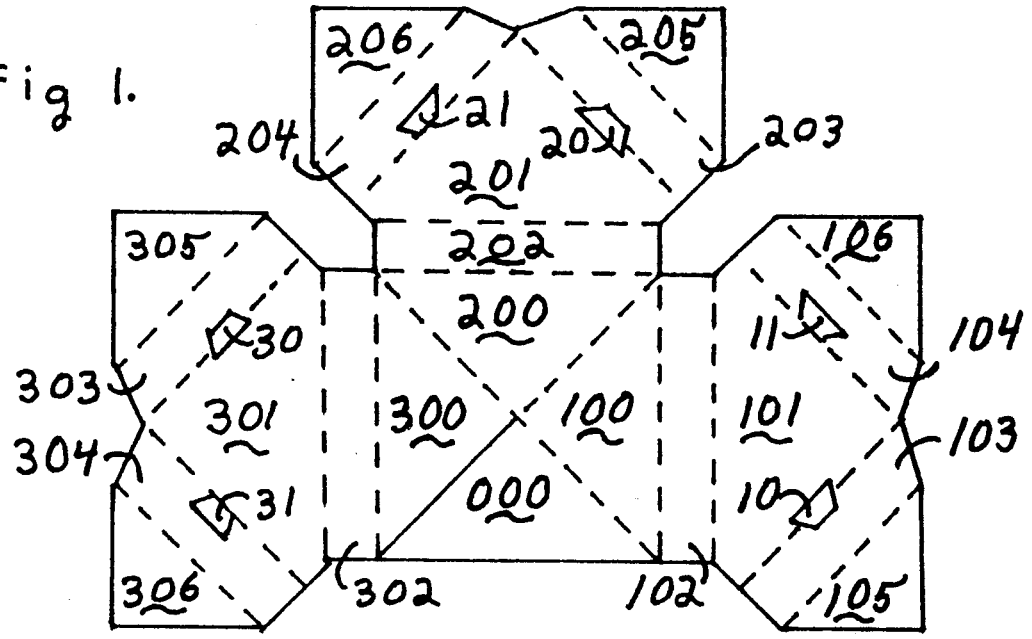
Figure 2A:
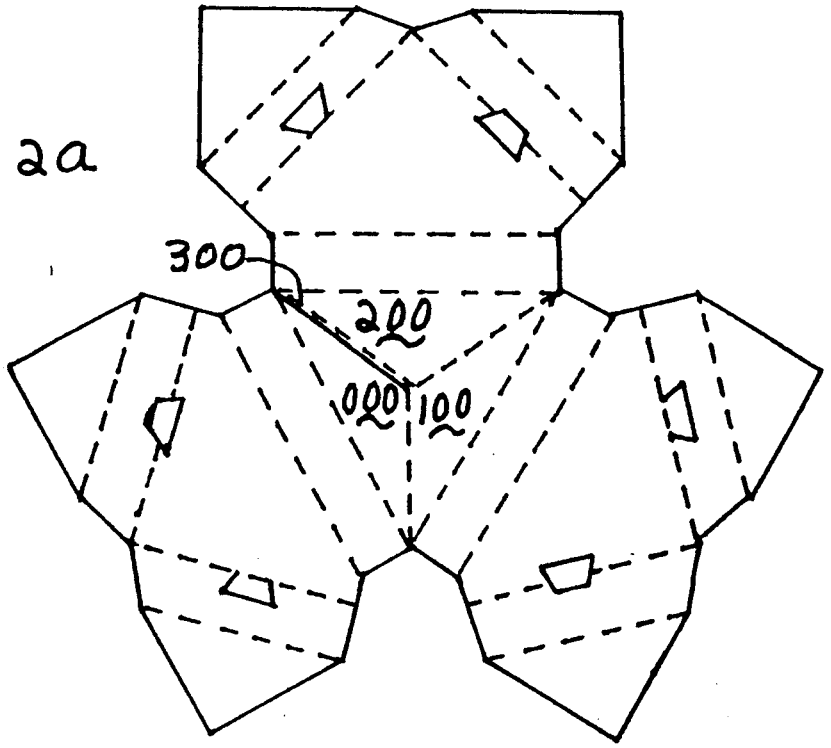
Figure 2B:
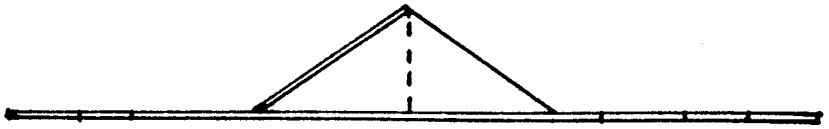
Figure 3A:
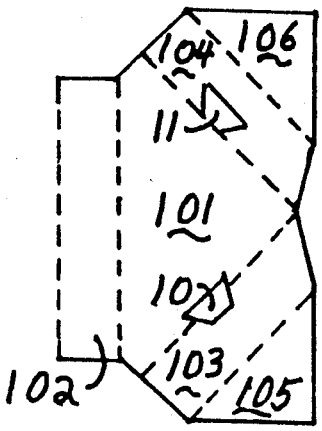
Figure 3B:
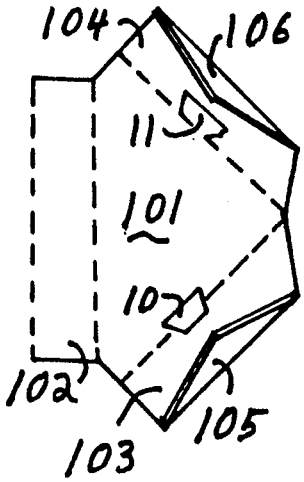
Figure 3C:
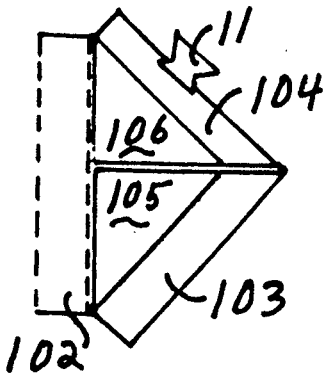
Figure 3C:
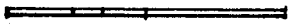
Figure 3C:
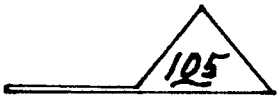
Figure 3C:
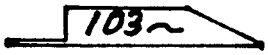

FIG. 1 shows the Volumetric Corner Protector construction in blank form. The three inner triangles 100, 200, and 300, are the inner panels of the corner protector. The forth inner triangle, triangle 000, overlaps triangle 300 to provide support. The three larger triangles 101, 201, and 301, form the outer panels.

Sections 102, 202, and 302, form the perpendicular supports, and sections 103, 104, 203, 204, 303, and 304, form the diagonal supports of the corner protector. Small triangular sections 105, 106, 205, 206, 305, and 306, are the support panels to hold the diagonals in position.

Sections 10, 11, 20, 21, 30, and 31, form tab locks which are common to the packaging industry. These tab locks hold the outer panels 101, 201, and 301 together after folding. The solid lines in the FIG. 1 thru FIG. 8 represent edges or cuts. The dash lines represent bend lines.

The Volumetric Corner Protector is formed from the blank in FIG. 1 by lifting section 000 along its cut, and then rotating sections 100 thru 106 and sections 300 thru 306 together while pushing up on the intersection of section 000, section 100, section 200, and section 300, until section 000 overlaps section 300 to become the inner panels, FIG. *2a,b*. Sections 101 thru 106, FIG. *3a*, are then folded by first folding 105 and 106 upward, FIG. *3b*, and then sections 103 and 104 along with sections 105 and 106 are folded upward until one edge of 105 and 106 come together, and sections 105 and 106 form a plane, FIG. *3c*. The locking tab section 11 is not folded at this time.

Figure 4:
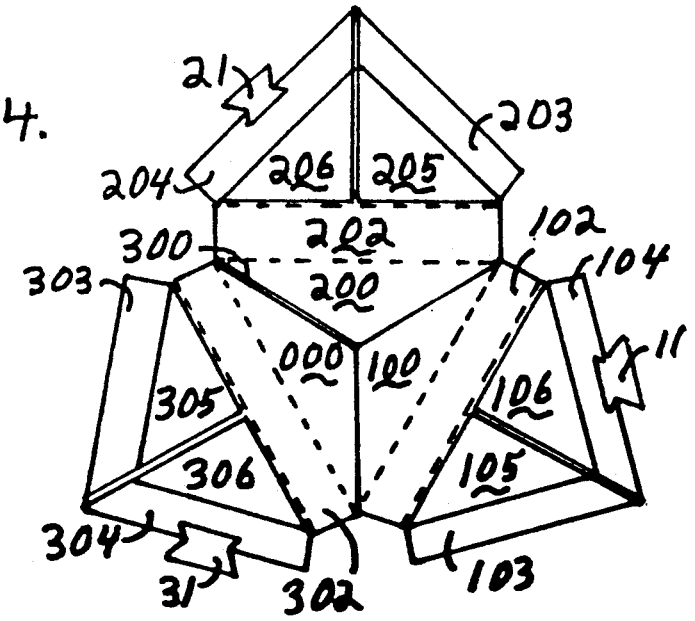

Sections 201 thru 206 and section 301 thru 306 are similar to sections 101 thru 106 and are folded in the same manner to form the construction in FIG. 4.

Sections 100 thru 106 are folded by folding section 101 thru 106 upward until section 100 is adjacent to 105 and 106, and point a and b of FIG. *5a* come together, FIG. *5b*. Sections 200 thru 206 and sections 300 thru 306 are similar to sections 100 thru 106 and are folded in the same manner to form the construction of FIG. *6a*.

The tab locks 11, 21, and 31 are now adjacent to the tab lock cut outs 10, 20, and 30, and 11, 21, and 31 are folded into their adjacent cut-outs to lock the Volumetric Corner Protector together.

Figure 7:
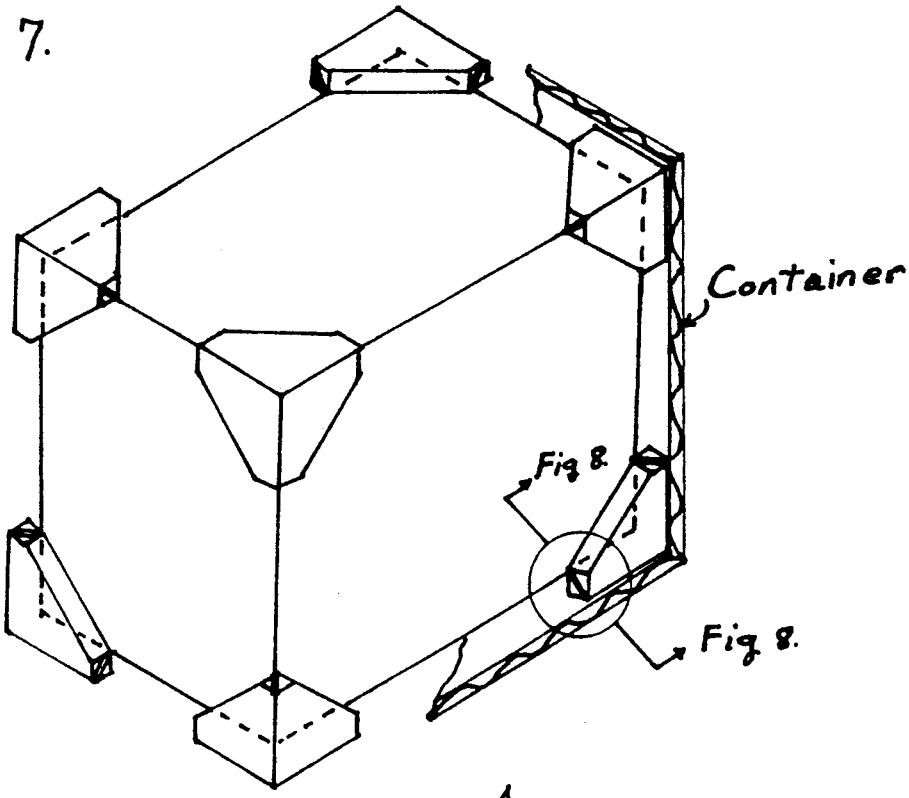
FIG. 7 shows the perspective view of how the Volumetric Corner Protector (FIG. 1) would support a rectangular object in a box container.

The corner protector just described is shown in perspective in FIG. *6b* and FIG. 7. In FIG. 7, it is shown to support an item, such as a speaker cabinet, in a container.

Figure 8:
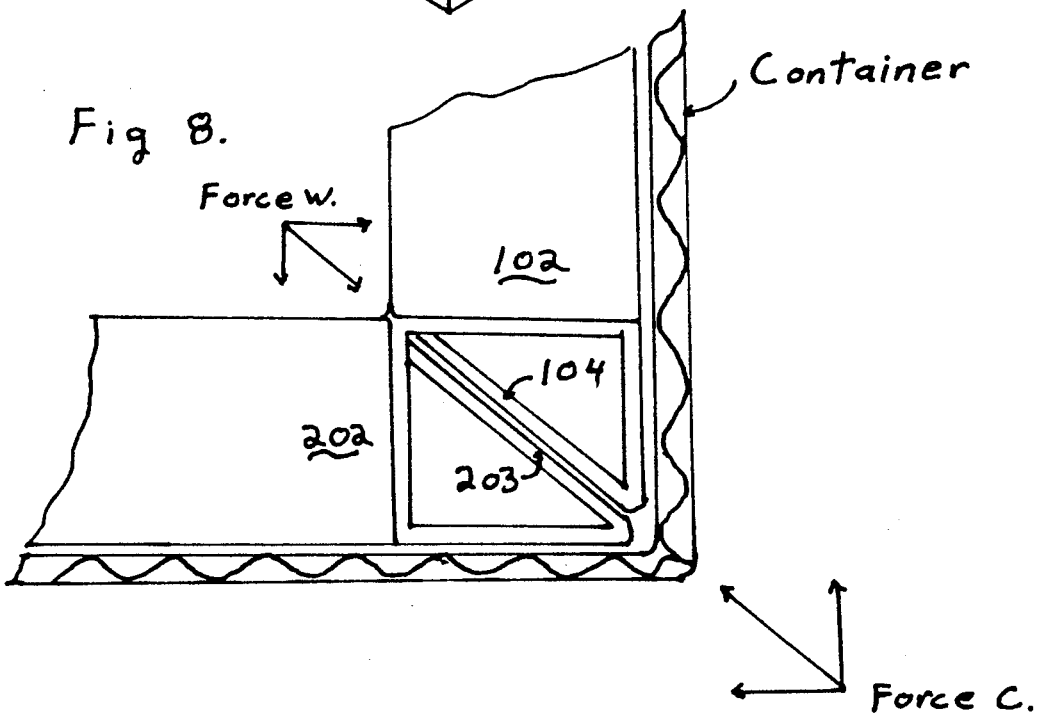
FIG. 8 shows the container and the diagonal bracing formed by the Volumetric Corner Protector (FIG. 1) used together to support the item.

The unique design of the present invention creates diagonal and perpendicular supports which provide exceptional strength and crush relationships which can be utilized in selecting a corner protector for a given application, FIG. 8. For example, if more space is needed between an item and its container, this space can be added by increasing the length of the diagonal and perpendicular support sections. This increase adds very little material or cost as compared to corner protectors made of layers of material. Variable crush strengths can be provided by using different standards of corrugated paperboard, without a major change in tooling. When the above variables are combined to a suitable strength, a corner protector can be made from corrugated paperboard, or the like, using the same folding pattern. Using the same folding pattern for many applications will allow for the economic construction of automatic folding equipment, the lack of which has made many types of corrugated corner protectors non-competitive with the foam type corners. Other details of construction could also be changed without departing from the principles as set forth in the claims.

What is claimed is:

1. A corner protector formed from a blank of paperboard material to be applied to the outside corner of an article, said corner protector being folded and formed from a flat blank of pre-cut and pre-scored board material, said corner protector in the flat blank form consisting of six outer triangular panels, six outer rectangular panels, three middle triangular panels, three middle rectangular panels, and four center triangular panels laid-out in a center rectangular pattern, said panels being connected along an edge by pre-scored fold lines forming hinged panels which can be folded relative to each other, said center triangular panels are arranged in a center rectangular pattern which has its sides and intersecting diagonals formed from pre-scored and pre-cut lines forming four center triangular panels three of, said center triangular panels being connected by pre scored fold lines, and two adjacent of said center triangular panels being separated by a pre-cut line and one of said adjacent center triangular panels having a second edge formed by a pre-cut line which is an outer edge of the center rectangular pattern, said center triangular panels having at least two pre-scored fold lines each being connected by one of those lines to one of the three middle rectangular panels, said middle rectangular panels having two pre-scored lines opposite each other and two pre-cut lines each adjacent to two pre-scored fold lines each of said middle rectangular panels being connected to one of said three middle triangular panels opposite a center triangular panel, said middle triangular panels each being connected to two of the six outer rectangular panels along two different pre-scored fold lines and opposite a middle triangular panel, said outer rectangular panels having two pre-scored fold lines opposite each other and two pre-cut lines each adjacent to said two pre-scored fold lines each of said outer rectangular panels being connected along a pre-scored fold line to one of the six outer triangular panels, said outer triangular panels having one pre-scored fold line and two adjacent pre-cut lines and connected opposite a middle triangular panel, said middle triangular and outer rectangular panels having pre-scored and pre-cut regions forming locking tabs to hold the form together after folding.

* * * * *